US006638028B1

(12) United States Patent
Poulin, Jr.

(10) Patent No.: US 6,638,028 B1
(45) Date of Patent: Oct. 28, 2003

(54) STOVETOP BLOWER APPARATUS FOR PREVENTING BOIL OVER

(76) Inventor: Richard A. Poulin, Jr., 25 Budron Ave., Salem, NH (US) 03079

( * ) Notice: Subject to any disclaimer, the term of this patent is extended or adjusted under 35 U.S.C. 154(b) by 0 days.

(21) Appl. No.: 10/028,105

(22) Filed: Dec. 21, 2001

(51) Int. Cl.[7] ..... F04B 19/00; F04B 35/00; F04B 17/00

(52) U.S. Cl. ..... 417/238; 417/326; 417/411; 417/423.15; 417/423.14

(58) Field of Search ..... 417/12, 63, 238, 417/326, 411, 423.7, 423.15, 423.14, 424.1

(56) References Cited

U.S. PATENT DOCUMENTS 3,347,220 A 10/1967 Barbera, Sr.
3,647,323 A 3/1972 Thomas
3,697,198 A * 10/1972 Holder, Jr. ..... 417/411
4,044,750 A 8/1977 Zeigler
4,687,414 A * 8/1987 Wardy ..... 416/63
4,831,735 A * 5/1989 Bast et al. ..... 30/433
4,918,857 A * 4/1990 Wade et al. ..... 43/139
4,954,049 A * 9/1990 Armbruster ..... 417/234
5,115,566 A 5/1992 Zeitlin
5,181,836 A 1/1993 Zeitlin
5,658,128 A * 8/1997 Green ..... 415/121.3

* cited by examiner

*Primary Examiner*—Charles G. Freay
*Assistant Examiner*—Timothy P. Solak

(57) ABSTRACT

A blower apparatus for preventing pots being used to heat liquid from boiling over. The blower apparatus includes a blower housing having an outlet nozzle; a blower assembly positioned in the blower housing for pushing a stream of air out of the housing through the outlet nozzle, the outlet nozzle is positioned at a top of the housing thus the outlet nozzle is designed for directing the stream of air over an adjacently positioned piece of cookware in which a liquid is being heated.

19 Claims, 5 Drawing Sheets

STOVETOP BLOWER APPARATUS FOR PREVENTING BOIL OVER

BACKGROUND OF THE INVENTION

1. Field of the Invention

The present invention relates to airflow directing assemblies and more particularly pertains to a new blower apparatus for preventing pots being used to heat liquid from boiling over.

2. Description of the Prior Art

The use of airflow directing assemblies is known in the prior art. More specifically, airflow directing assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,658,128; U.S. Pat. No. 5,181,836; U.S. Pat. No. 5,115,566; U.S. Pat. No. 3,647,323; U.S. Pat. No. 3,347.220: and U.S. Pat. No. 4,044,750.

While these devices fulfill their respective, particular objectives and requirements, the aforementioned patents do not disclose a new blower apparatus. The inventive device includes a blower housing having an outlet nozzle; a blower assembly positioned in the blower housing for pushing a stream of air out of the housing through the outlet nozzle, the outlet nozzle is positioned at a top of the housing thus the outlet nozzle is designed for directing the stream of air over an adjacently positioned piece of cookware in which a liquid is being heated.

In these respects, the blower apparatus according to the present invention substantially departs from the conventional concepts and designs of the prior art, and in so doing provides an apparatus primarily developed for the purpose of preventing pots being used to heat liquid from boiling over.

SUMMARY OF THE INVENTION

In view of the foregoing disadvantages inherent in the known types of airflow directing assemblies now present in the prior art, the present invention provides a new blower apparatus construction wherein the same can be utilized for preventing pots being used to heat liquid from boiling over.

The general purpose of the present invention, which will be described subsequently in greater detail, is to provide a new blower apparatus and method which has many of the advantages of the airflow directing assemblies mentioned heretofore and many novel features that result in a new blower apparatus which is not anticipated, rendered obvious, suggested, or even implied by any of the prior art airflow directing assemblies, either alone or in any combination thereof.

To attain this, the present invention generally comprises a blower housing having an outlet nozzle; a blower assembly positioned in the blower housing for pushing a stream of air out of the housing through the outlet nozzle, the outlet nozzle is positioned at a top of the housing thus the outlet nozzle is designed for directing the stream of air over an adjacently positioned piece of cookware in which a liquid is being heated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new blower apparatus and method which has many of the advantages of the airflow directing assemblies mentioned heretofore and many novel features that result in a new blower apparatus which is not anticipated, rendered obvious, suggested, or even implied by any of the prior art airflow directing assemblies, either alone or in any combination thereof.

It is another object of the present invention to provide a new blower apparatus which may be easily and efficiently manufactured and marketed.

It is a further object of the present invention to provide a new blower apparatus which is of a durable and reliable construction.

An even further object of the present invention is to provide a new blower apparatus which is susceptible of a low cost of manufacture with regard to both materials and labor, and which accordingly is then susceptible of low prices of sale to the consuming public, thereby making such blower apparatus economically available to the buying public.

Still yet another object of the present invention is to provide a new blower apparatus which provides in the apparatuses and methods of the prior art some of the advantages thereof, while simultaneously overcoming some of the disadvantages normally associated therewith.

Still another object of the present invention is to provide a new blower apparatus for preventing pots being used to heat liquid from boiling over.

Yet another object of the present invention is to provide a new blower apparatus which includes a blower housing having an outlet nozzle; a blower assembly positioned in the blower housing for pushing a stream of air out of the housing through the outlet nozzle, the outlet nozzle is positioned at a top of the housing thus the outlet nozzle is designed for directing the stream of air over an adjacently positioned piece of cookware in which a liquid is being heated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
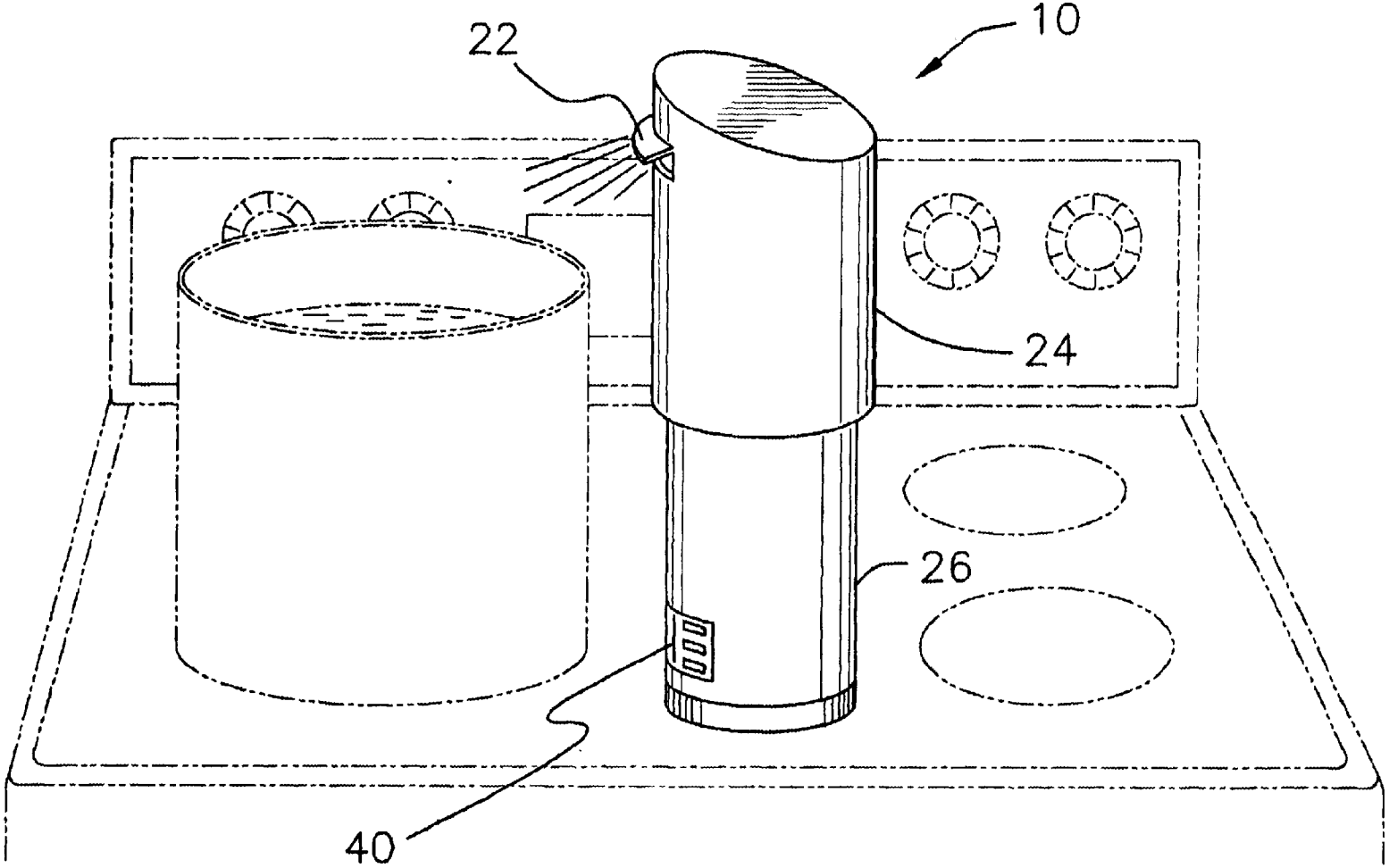
FIG. 1 is a schematic perspective view of a new blower apparatus according to the present invention in use.
Figure 2:
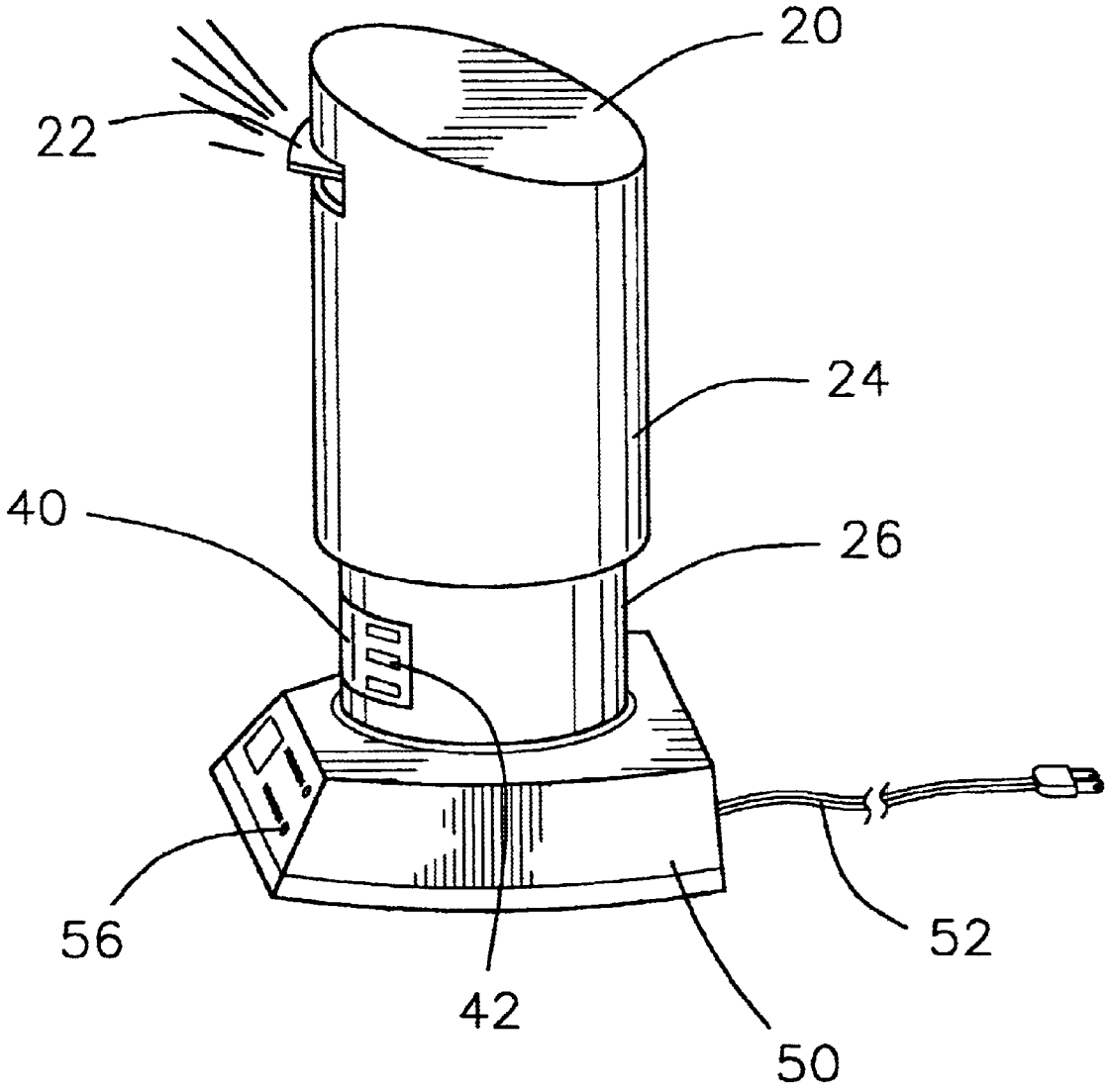
FIG. 2 is a schematic perspective side view of the present invention.
Figure 3:
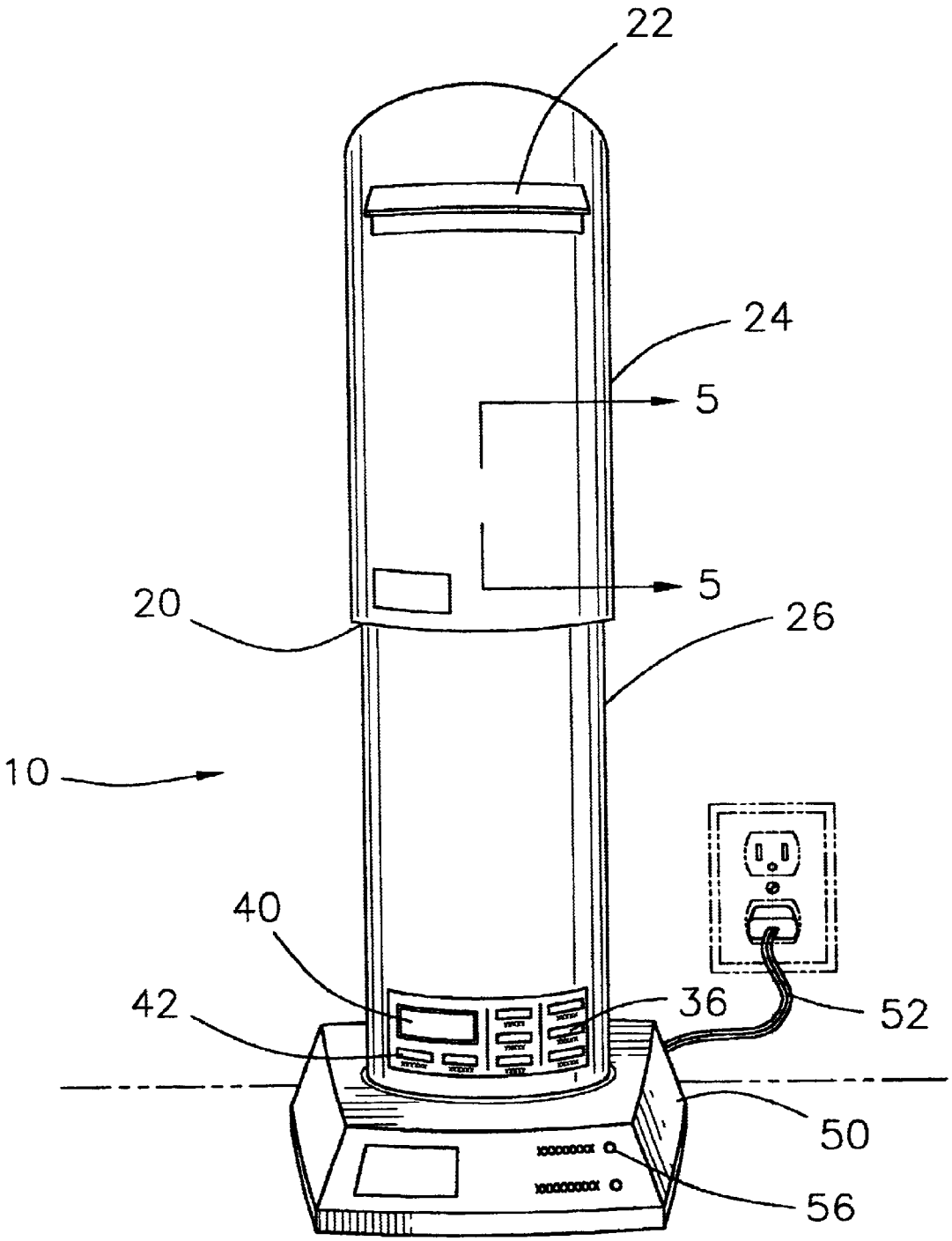
FIG. 3 is a schematic perspective front view of the present invention.
Figure 4:
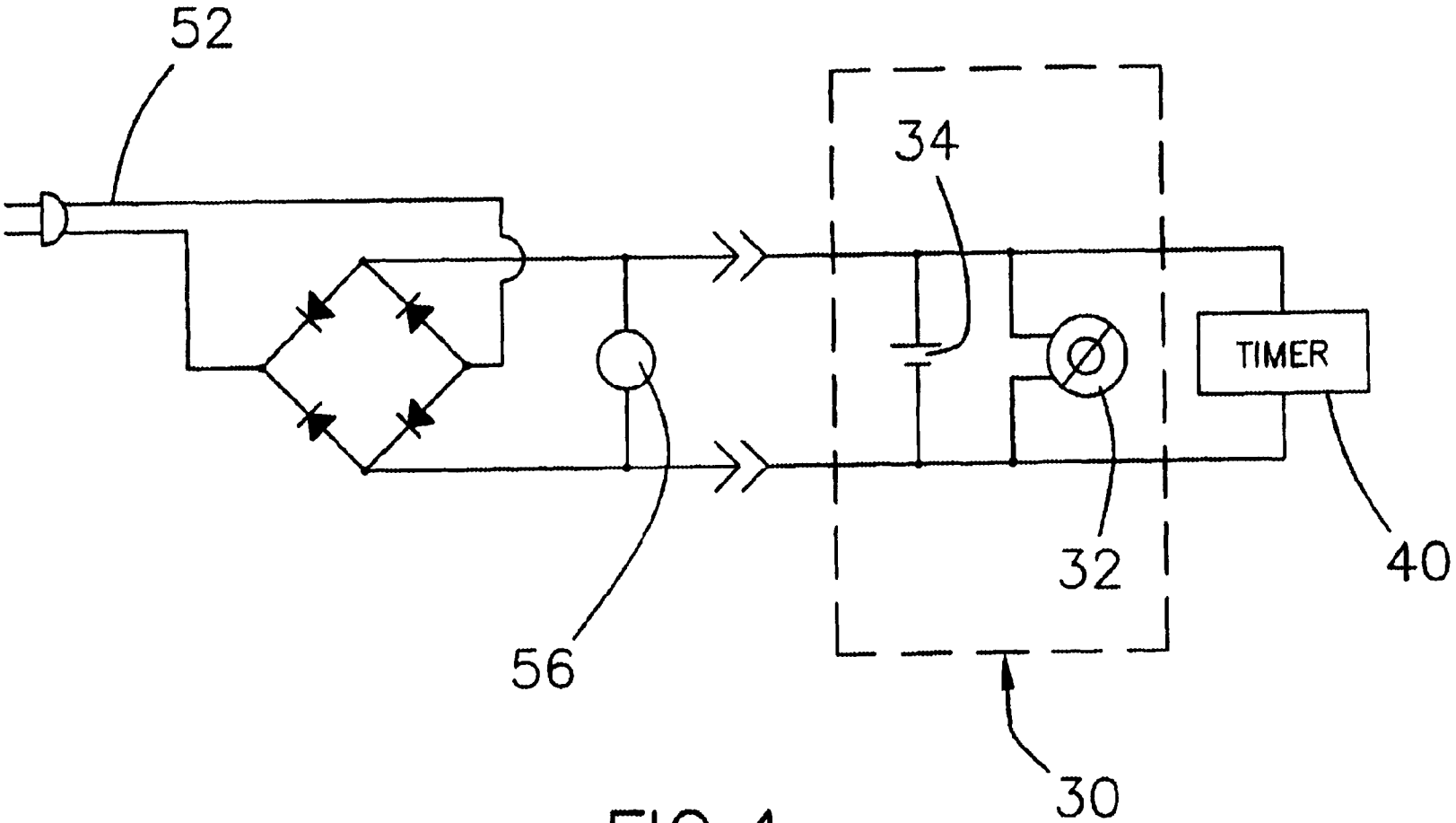
FIG. 4 is a schematic interconnect diagram of the present invention.
Figure 5:
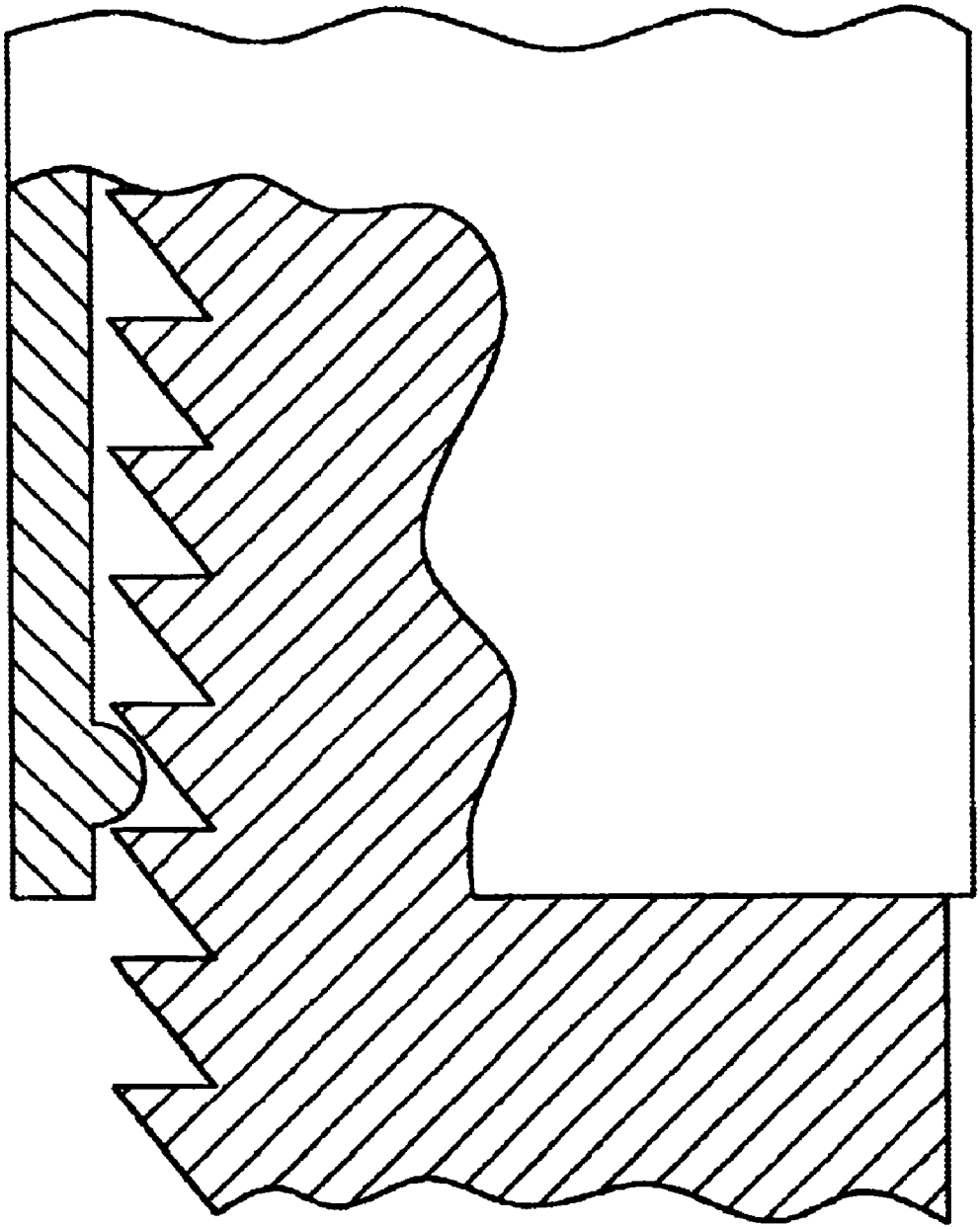
FIG. 5 is a schematic cross-sectional diagram of the present invention.

With reference now to the drawings, and in particular to FIGS. 1 through 4 thereof, a new blower apparatus embodying the principles and concepts of the present invention and generally designated by the reference numeral 10 will be described.

As best illustrated in FIGS. 1 through 4, the blower apparatus 10 generally comprises a blower housing 20, a blower assembly 30, and a base unit 50.

The blower housing 20 includes an outlet nozzle 22. The blower assembly 30 is preferably positioned in the blower housing 20 for pushing a stream of air out of the housing 20 through the outlet nozzle 22. The outlet nozzle 22 is positioned at a top of the housing 20. Thus, the outlet nozzle 22 is designed for directing the stream of air over an adjacently positioned piece of cookware in which a liquid is being heated. The blower assembly 30 includes a fan 32 and a rechargeable battery 34 for providing power to the fan 32.

The base unit 50 includes an electrical cord 52 designed for coupling to an electrical outlet. The blower housing 20 is couplable to the base unit 50 for recharging the battery 34 when the base unit 50 is coupled to the electrical outlet.

The blower housing 20 includes an upper portion 24 and a lower portion 26. The upper portion 24 is telescopically coupled to the lower portion 26 for adjusting a height of the outlet nozzle 22.

A timer 40 may be coupled to the blower housing 20. A timer adjustment means 42 is used for setting the timer 40 to provide an audible signal at a time corresponding to a desired duration of heating.

The top of the blower housing 20 may be tilted for adjusting a direction of the stream of air from the outlet nozzle 22. A plurality of blower speed button 36 is operationally coupled to the blower assembly 30 for adjusting a speed of the fan 32.

The upper portion 24 of the blower housing 20 includes an open bottom. The lower portion 26 of the blower housing 20 is insertable into the open bottom. A plurality of teeth extends from an exterior of the lower portion 26. The upper portion 24 includes a protrusion positionable between a selectable pair of the teeth for holding the housing 20 in a desired extended position.

The base unit 50 includes a first pair of electrical contacts electrically coupled to the electrical cord 52. The blower housing 20 includes a second pair of electrical contacts electrically coupled to the battery 34. The second pair of electrical contacts is positioned to mate with the first pair of electrical contacts when the blower housing 20 is coupled to the base unit 50. Thus, the battery 34 is recharged when the electrical cord 52 is connected to a source of electricity.

A recharging light 56 is preferably positioned on the base unit 50 and electrically coupled to the first pair of electrical contacts such that the recharging light 56 is illuminated during recharging of the battery 34.

In a preferred embodiment, the blower housing 20 includes a weighted base for improving the stability of the blower apparatus 10 during use.

In a further embodiment, the blower housing 20 is adjustable for use such that the height of the outlet nozzle 22 is between 3 and 14 inches inclusive.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blower apparatus for preventing boiling over of a liquid during heating, said blower apparatus comprising:

a blower housing having an outlet nozzle;

a blower assembly positioned in said blower housing for pushing a stream of air out of said housing through said outlet nozzle, said outlet nozzle being positioned at a top of said housing whereby said outlet nozzle is adapted for directing the stream of air over an adjacently positioned piece of cookware in which a liquid is being heated;

a timer coupled to said blower housing; and a timer adjustment means for setting said timer to provide an audible signal at a time corresponding to a desired duration of heating.

2. The blower apparatus of claim 1, further comprising:

said blower assembly including a fan and a rechargeable battery for providing power to said fan;

a base unit having an electrical cord adapted for coupling to an electrical outlet, said blower housing being couplable to said base unit for recharging said battery when said base unit is coupled to the electrical outlet.

3. The blower apparatus of claim 1, further comprising:

said blower housing having an upper portion and a lower portion, said upper portion being telescopically coupled to said lower portion for adjusting a height of said outlet nozzle.

4. The blower apparatus of claim 1, further comprising:

a timer coupled to said blower housing;

a timer adjustment means for setting said timer to provide an audible signal at a time corresponding to a desired duration of heating.

5. The blower apparatus of claim 1, further comprising:

said top of said blower housing being tiltable for adjusting a direction of said stream of air from said outlet nozzle.

6. The blower apparatus of claim 1, further comprising:

said blower assembly including a fan;

a plurality of blower speed button operationally coupled to said blower assembly for adjusting a speed of said fan.

7. The blower assembly of claim 1, wherein said blower housing further comprises a weighted base portion for providing additional stability from tipping when in use.

8. A blower apparatus for preventing boiling over of a liquid during heating, said blower apparatus comprising:

a blower housing having an outlet nozzle;

a blower assembly positioned in said blower housing for pushing a stream of air out of said housing through said outlet nozzle, said outlet nozzle being positioned at a top of said housing whereby said outlet nozzle is adapted for directing the stream of air over an adjacently positioned piece of cookware in which a liquid is being heated; and said blower housing having an upper portion and a lower portion, said upper portion being telescopically coupled to said lower portion for adjusting a height of said outlet nozzle.

9. The blower apparatus of claim 8, further comprising:

said blower assembly including a fan and a rechargeable battery for providing power to said fan;

a base unit having an electrical cord adapted for coupling to an electrical outlet, said blower housing being couplable to said base unit for recharging said battery when said base unit is coupled to the electrical outlet.

10. The blower apparatus of claim 9, further comprising:

said base unit having a first pair of electrical contacts electrically coupled to said electrical cord;

said blower housing having a second pair of electrical contacts electrically coupled to said battery, said second pair of electrical contacts being positioned to mate with said first pair of electrical contacts when said blower housing is coupled to said base unit whereby said battery is recharged when said electrical cord is connected to a source of electricity.

11. The blower apparatus of claim 10, further comprising:

a recharging light positioned on said base unit and electrically coupled to said first pair of electrical contacts such that said recharging light is illuminated during recharging of said battery.

12. The blower apparatus of claim 8, further comprising:

a timer coupled to said blower housing;

a timer adjustment means for setting said timer to provide an audible signal at a time corresponding to a desired duration of heating.

13. The blower apparatus of claim 8, further comprising:

said top of said blower housing being tiltable for adjusting a direction of said stream of air from said outlet nozzle.

14. The blower apparatus of claim 8, further comprising:

said blower assembly including a fan;

a plurality of blower speed button operationally coupled to said blower assembly for adjusting a speed of said fan.

15. The blower apparatus of claim 8, further comprising:

said upper portion of said blower housing having an open bottom;

said lower portion of said blower housing being insertable into said open bottom;

a plurality of teeth extending from an exterior of said lower portion;

said upper portion having a protrusion positionable between a selectable pair of said teeth for holding said housing in a desired extended position.

16. The blower assembly of claim 3, wherein said blower housing further comprises a weighted base portion for providing additional stability from tipping when in use.

17. A blower apparatus for preventing boiling over of a liquid during heating, said blower apparatus comprising:

a blower housing having an outlet nozzle;

a blower assembly positioned in said blower housing for pushing a stream of air out of said housing through said outlet nozzle, said outlet nozzle being positioned at a top of said housing whereby said outlet nozzle is adapted for directing the stream of air over an adjacently positioned piece of cookware in which a liquid is being heated;

said blower assembly including a fan and a rechargeable battery for providing power to said fan;

a base unit having an electrical cord adapted for coupling to an electrical outlet, said blower housing being couplable to said base unit for recharging said battery when said base unit is coupled to the electrical outlet;

said blower housing having an upper portion and a lower portion, said upper portion being telescopically coupled to said lower portion for adjusting a height of said outlet nozzle;

a timer coupled to said blower housing;

a timer adjustment means for setting said timer to provide an audible signal at a time corresponding to a desired duration of heating;

said top of said blower housing being tiltable for adjusting a direction of said stream of air from said outlet nozzle;

a plurality of blower speed button operationally coupled to said blower assembly for adjusting a speed of said fan;

said upper portion of said blower housing having an open bottom;

said lower portion of said blower housing being insertable into said open bottom;

a plurality of teeth extending from an exterior of said lower portion;

said upper portion having a protrusion positionable between a selectable pair of said teeth for holding said housing in a desired extended position;

said base unit having a first pair of electrical contacts electrically coupled to said electrical cord;

said blower housing having a second pair of electrical contacts electrically coupled to said battery, said second pair of electrical contacts being positioned to mate with said first pair of electrical contacts when said blower housing is coupled to said base unit whereby said battery is recharged when said electrical cord is connected to a source of electricity; and a recharging light positioned on said base unit and electrically coupled to said first pair of electrical contacts such that said recharging light is illuminated during recharging of said battery.

18. The blower assembly of claim 17, wherein said blower housing further comprises a weighted base portion for providing additional stability from tipping when in use.

19. The blower assembly of claim 17, wherein said upper and lower portions of said blower housing being telescopically adjustable such that an operating height of said outlet nozzle being adjustable in a range from 3 to 14 inches inclusive.

* * * * *